US011959346B2

(12) United States Patent
Tian et al.

(10) Patent No.: US 11,959,346 B2
(45) Date of Patent: Apr. 16, 2024

(54) METHOD FOR OFFSHORE DUAL-DRIVE CORE DRILLING WITH THREE LAYERS OF CASINGS UNDER SURGE COMPENSATION

(71) Applicant: GUANGZHOU MARINE GEOLOGICAL SURVEY, Guangzhou (CN)

(72) Inventors: Lieyu Tian, Guangzhou (CN); Wu Guo, Guangzhou (CN); Nan Yang, Guangzhou (CN); Zhanzhao Li, Guangzhou (CN)

(73) Assignee: GUANGZHOU MARINE GEOLOGICAL SURVEY, Guangzhou (CN)

( * ) Notice: Subject to any disclaimer, the term of this patent is extended or adjusted under 35 U.S.C. 154(b) by 0 days.

(21) Appl. No.: 18/260,038

(22) PCT Filed: Sep. 17, 2021

(86) PCT No.: PCT/CN2021/118981

§ 371 (c)(1),
(2) Date: Jun. 30, 2023

(87) PCT Pub. No.: WO2022/151751

PCT Pub. Date: Jul. 21, 2022

(65) Prior Publication Data

US 2024/0060378 A1 Feb. 22, 2024

(30) Foreign Application Priority Data

Sep. 7, 2021 (CN) ..... 202111043794.6

(51) Int. Cl.

| | |
|---|---|
| ***E21B 25/18*** | (2006.01) |
| ***E21B 7/12*** | (2006.01) |
| ***E21B 15/02*** | (2006.01) |
| ***E21B 19/00*** | (2006.01) |
| ***E21B 19/16*** | (2006.01) |
| ***E21B 21/00*** | (2006.01) |
| ***E21B 21/06*** | (2006.01) |

(52) U.S. Cl.
CPC ..... *E21B 25/18* (2013.01); *E21B 7/12* (2013.01); *E21B 15/02* (2013.01); *E21B 19/002* (2013.01);
(Continued)

(58) Field of Classification Search
CPC . E21B 25/18; E21B 7/12; E21B 15/02; E21B 19/002; E21B 19/06; E21B 21/001; E21B 21/063
See application file for complete search history.

(56) References Cited

U.S. PATENT DOCUMENTS 3,208,538 A * 9/1965 Pitcher ..... E21B 10/04 175/320
4,683,944 A * 8/1987 Curlett ..... E21B 21/12 175/215

(Continued)

FOREIGN PATENT DOCUMENTS

CN 102913162 A 2/2013
CN 108547587 A 9/2018

(Continued)

*Primary Examiner* — Aaron L Lembo
(74) *Attorney, Agent, or Firm* — Bayramoglu Law Offices LLC

(57) ABSTRACT

A method for offshore dual-drive core drilling with three layers of casings under surge compensation is provided. According to the method, a drilling vessel is located at set latitude and longitude coordinates by a dynamic positioning system; drill pipes are stabilized by a seabed template; torques and drilling pressures can be transmitted during drilling of the casings by means of surge compensation of the casings at a wellhead; during drilling for sampling, the surge compensation can compensate to a certain extent for a change in water depth caused by rising or falling tides, or surge, thereby preventing the casings from colliding with equipment and ensuring the safety of wellhead operation; and the drilling of three layers of casings is achieved by (Continued)

means of dual driver heads to effectively protect a wellbore wall, such that high core-drilling rate and good core-drilling quality are achieved during drilling for sampling.

7 Claims, 3 Drawing Sheets

(52) U.S. Cl.
CPC ..... *E21B 19/16* (2013.01); *E21B 21/001* (2013.01); *E21B 21/063* (2013.01)

(56) References Cited

U.S. PATENT DOCUMENTS

| | | | | |
|---|---|---|---|---|
| 4,836,305 | A * | 6/1989 | Curlett | E21B 21/08 175/320 |
| 10,145,982 | B2 * | 12/2018 | Yang | G01V 9/005 |
| 10,927,606 | B2 * | 2/2021 | Wan | E21B 7/124 |
| 11,377,921 | B2 * | 7/2022 | Burca | E21B 29/005 |
| 2010/0224360 | A1 | 9/2010 | MacDougall et al. | |
| 2012/0055678 | A1 * | 3/2012 | Humphreys | E21B 33/035 166/358 |
| 2016/0053558 | A1 * | 2/2016 | Tan | B63B 35/4413 175/52 |
| 2016/0208586 | A1 * | 7/2016 | Perschke | E21B 17/18 |
| 2016/0222735 | A1 * | 8/2016 | Chambless | E21B 19/143 |

FOREIGN PATENT DOCUMENTS

| | | | |
|---|---|---|---|
| CN | 209025628 | U | 6/2019 |
| CN | 110578486 | A | 12/2019 |
| CN | 210888838 | U | 6/2020 |
| CN | 111980613 | A | 11/2020 |
| CN | 113914803 | A | 1/2022 |
| EP | 1103459 | A1 | 5/2001 |
| WO | 2020169255 | A1 | 8/2020 |

* cited by examiner

METHOD FOR OFFSHORE DUAL-DRIVE CORE DRILLING WITH THREE LAYERS OF CASINGS UNDER SURGE COMPENSATION

CROSS REFERENCE TO THE RELATED APPLICATIONS

This application is the national phase entry of International Application No. PCT/CN2021/118981, filed on Sep. 17, 2021, which is based upon and claims priority to Chinese Patent Application No. 202111043794.6, filed on Sep. 7, 2021, the entire contents of which are incorporated herein by reference.

TECHNICAL HELD

The present invention relates to the field of offshore drilling technologies, and in particular to a method for offshore shallow core drilling with dynamic vessel positioning and double drilling driver heads under surge compensation at mouths of outer casings and heave compensation during drilling of the casings.

BACKGROUND

Unlike land drilling, offshore core drilling operations are confronted with strong winds and waves and complex seabed bottoms, leading to difficulty in core drilling. As a result, casings are usually required for wall protection. At present, land core drilling technologies have been well established, but drilling technologies over waterways, in particular offshore core drilling technologies have not been well developed. There is no safe and applicable core drilling method for strata where it is difficult to perform core drilling.

SUMMARY

An object of the present invention is to overcome the shortcomings of the prior art and to provide a method for offshore dual-drive core drilling with three layers of casings under surge compensation, which may be used in core drilling of strata that are difficult to drill in the seabed.

To achieve the above object, the technical solutions of the present invention are as follows.

A method for offshore dual-drive core drilling with three layers of casings under surge compensation includes the steps of:

(I) providing a device for offshore dual-drive core drilling with three layers of casings under surge compensation, the device specifically including:

a drilling vessel with a dynamic positioning system, wherein the drilling vessel has a deck provided with a moon pool and a tower, the moon pool is provided with a moon pool cover on a top, the moon pool cover is provided with a pneumatic slip in a center, and an elevatable seabed template is also suspended in the moon pool;

A drilling tool system, including outer casings, inner casings, drill pipes, and a surge compensator, wherein the surge compensator is configured to connect the outer casings to prevent the outer casings from colliding with wellhead equipment;

An outer-casing drilling system, including a tower-mounted traveling block, a top driver mounted on the traveling block, and a hydraulic elevator mounted on the top driver, wherein the top driver is configured to provide the outer casings with a rotation power, the traveling block is vertically movable and configured to provide a longitudinal feed to achieve drilling of the outer casings, and the hydraulic elevator is configured to pick the outer casings and assist buckling of the outer casings;

An inner-casing and drill-pipe drilling system, including a vertical-spindle type drill and a winch, wherein the vertical-spindle type drill is movably mounted next to the moon pool and is configured to provide the inner casings and the drill pipes with a drilling power, the winch is mounted on the deck, configured to hoist the inner casings and the drill pipes and provided with a matched drawing head, the vertical-spindle type drill has a drill guide rail provided with a matched counterweight, and a drilling pressure is adjusted for the inner casings and the drill pipes by coordination between the counterweight and the winch; and A mud circulation system, including a deck-mounted mud recovery tank, a mud filter, a mud pool, and a mud pump, wherein the inner casings are connected to the mud recovery pool by means of a pipeline, the mud recovery pool is connected to the mud filter by means of a pipeline, the mud filter is connected to the mud pool by means of a pipeline, the mud pool is connected to the mud pump by means of a pipeline, and the mud pump is connected to the drill pipes by means of a pipeline, thereby forming a mud circulation loop; and (II) performing core drilling by using the device for offshore dual-drive core drilling with three layers of casings under surge compensation, specifically including:

(1) sailing the drilling vessel to a designated station, and enabling dynamic positioning to stabilize a wellhead at a designated sampling position;

(2) allowing an initial position of the vertical-spindle type drill to reside next to the moon pool, the seabed template to reside in the moon pool, and the traveling block, the top driver and the hydraulic elevator to reside on an uppermost end, and limiting the counterweight to an uppermost end of the drill guide rail;

(3) opening the pneumatic slip, clamping the outer casing with a drill bit by the hydraulic elevator, delivering the outer casing into the pneumatic slip which clamps the outer casing, continuing to clamp another outer casing with the hydraulic elevator, aligning the another outer casing to the outer casing clamped by the pneumatic slip, tightening and buckling the outer casings, repeatedly connecting a plurality of outer casings such that the outer casings pass through the pneumatic slip, the moon pool and the seabed template till the drill bit is close to the seabed, connecting the outer casings to the surge compensator, and then continuing to connect the outer casing, till the drill bit reaches the seabed;

(4) lowering the seabed template to the seabed;

(5) connecting the top driver to the outer casings, starting the top driver to drill, lifting the outer casings after drilling to a certain depth such that the surge compensator is in a middle position, then closing the pneumatic slip to clamp the outer casings, disconnecting the outer casing from the top driver, and elevating the top driver, to leave the outer casings as a first layer of wall protection casings;

(6) connecting the drawing head to the inner casing with a drill bit, starting the winch, delivering the inner casing into the outer casings, clamping the inner casing to a mouth of the corresponding outer casing by callipers, continuing to draw another inner casing to an interface of the previous inner casing, buckling and connecting the inner casings, and repeatedly connecting a plurality of inner casings, till the drill bit reaches the seabed;

(7) moving the vertical-spindle type drill to a wellhead position to connect the inner casings, connecting the counterweight to the drawing head, releasing the limit of the counterweight, starting drilling to allow the inner casings to begin to rotate, adjusting a drilling pressure by means of the winch and the counterweight, stop drilling after drilling to a certain footage, disconnecting the inner casings from the vertical-spindle type drill to leave the inner casings as a second layer of casing, returning the counterweight to the uppermost end of the drill guide rail, disconnecting the counterweight from the drawing head, acid returning the vertical-spindle type drill to the initial position;

(8) connecting the drawing head to the drill pipe with the drill bit, starting the winch to deliver the drill pipe into the inner casings, clamping the drill pipe to the mouth of the corresponding inner casing by the calipers, continuing to draw another drill pipe to an interface of the previous drill pipe, buckling and connecting the inner casings, and repeatedly connecting a plurality of drill pipes, till the drill bit reaches the seabed;

(9) moving the vertical-spindle type drill to the wellhead position again to connect the drill pipes, connecting the counterweight to the drawing head, releasing the limit of the counterweight, starting drilling to allow the drill pipe to begin to rotate, adjusting the drilling pressure by the winch and the counterweight, ending a first round after drilling to a certain footage, lifting the drill bit for core drilling, taking out a rock core sample from the core-drilling drill bit of the drill pipe, and cutting, cataloging and sealing the sample;

(10) starting a new round by reconnecting the drill pipes till the seabed is reached, connecting the vertical-spindle type drill, starting the mud pump to pump mud from the mud pool into the drill pipes, transporting the mud to the drill bit of the drill pipe to take away internal rock debris from a borehole and to return from the inner casings, returning the mud carrying the rock debris to the mud recovery pool, filtering the mud by the mud filter, returning the mud to the mud pool to achieve mud circulation, starting the vertical-spindle type drill to sweep the borehole till a sampling horizon is reached, turning off the mud pump, starting drilling for sampling, ending a current round after drilling to a certain footage, lifting the drill bit for core drilling, taking out a rock core sample from the coring drill bit of the drill pipe, and cutting, cataloging and sealing the sample; and

(11) repeating step (10) to achieve continuous sampling,

Further, the method further includes:

(12) when the drill pipes exceed the inner casings by an excessively long distance and with perception of a difficulty in mud returning and a risk of borehole collapse, drilling to advance the inner casings to a further depth, and then repeating step (10) for sampling.

Further, the method further includes:

(13) when the inner casings exceed the outer casings by an excessively long distance and a difficulty occurs during continuous further drilling, drilling to advance the outer casings to a further depth, and then drilling to advance the inner casings.

Preferably, the outer casings are $$5\frac{1''}{2}$$

casings.

Preferably, the inner casings are casings each having an outer diameter of 116 mm.

Preferably, the drill pipes each have an outer diameter of 97 mm.

Preferably, the mud is xanthan gum mud for taking away the rock debris and lubricating the drill pipes to prevent borehole collapse.

Compared with the prior art, the present invention has the following advantages:

1. the dynamic positioning system is used for the drilling vessel, which is suitable for offshore core-drilling operation at any depth;
2. the use of three layers of casings during drilling effectively protects the borehole and prevents the occurrence of drilling accidents, such that stability and reliability are achieved during drilling;
3. xanthan gum is non-toxic and nonhazardous as a raw material of the mud, and mud circulation is established, which is green and environmentally friendly;
4. high drilling efficiency and high core-drilling efficiency are achieved during actual sampling, and high-efficiency core drilling can be achieved even in strata that are difficult to drill and complex strata;
5. surge compensation is provided to prevent the casings from colliding with the wellhead equipment caused by waves and tides, such that the safety of operation is improved; and
6. the device is simple and reliable, with strong operability.

Description of reference signs: 1—traveling block; 2—top driver; 3—hydraulic elevator; 4—pulley; 5—winch; 6—vertical-spindle type drill; 7—drilling vessel; 8—moon pool cover; 9—pneumatic slip; 10—moon pool; 11—rock stratum; 12—seabed template; 13—casing and drilling tool; 14—mud recovery joint; 15—mud recovery pool; 16—mud filter; 17—mud pool; 18—mud pump; 19—drill guide rail; 20—counterweight; 21—drawing head; 22—steel wire rope; 201—drill pipe; 202—inner casing; 203—outer casing; 301—surge compensator.

DETAILED DESCRIPTION OF THE EMBODIMENTS

To make the above objects, features and advantages of the present invention more obvious and easier to understand, the present invention will be further described in detail below in conjunction with the accompanying drawings and particular embodiments.

Embodiments

In this embodiment, a method for offshore dual-drive core drilling with three layers of casings under surge compensation includes two portions.

Figure 1:
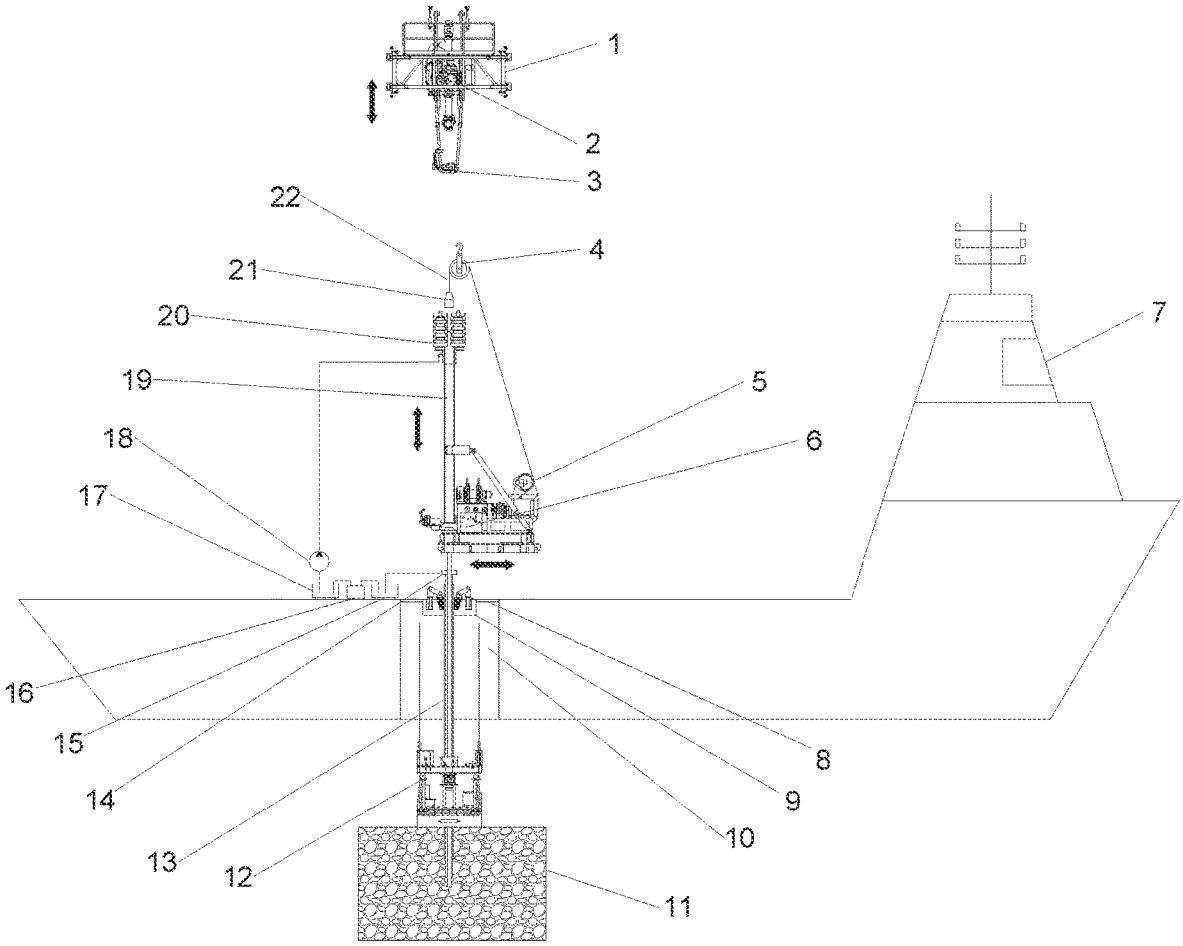
FIG. 1 is a schematic structural diagram of a device for core drilling used in the method for core drilling according to the present invention.

(I) A device for offshore dual-drive core drilling with three layers of casings under surge compensation as shown in FIG. 1 is provided. The device mainly includes a drilling vessel 7, as well as a drilling tool system, an outer-casing drilling system, an inner-casing and drill-pipe drilling system, and a mud circulation system, which are disposed on the drilling vessel 7.

The drilling vessel 7 includes a dynamic positioning system, which can allow a wellhead position to reside at designated coordinates by enabling dynamic positioning. The drilling vessel 7 has a deck provided with a moon pool 10 and a tower (not shown); the moon pool 10 is provided with a moon pool cover 8 on the top; the moon pool cover 8 is provided with a pneumatic slip 9 in the center; and an elevatable seabed template 12 is suspended in the moon pool 10.

The pneumatic slip 9 is a wedge block connected to a pneumatic piston, and is opened to allow the outer casings to vertically move and closed to clamp the outer casings, thereby limiting the downward movement of the outer casings.

The seabed template 12 is commercially available and is a tower-type steel space framework welded mainly by taking high-strength H-shaped steel as main members, in which individual portions are connected by means of bolts and shaft pins resistant to seawater corrosion. Tools such as submarine cameras and hydraulic calipers are installed for wellbore positioning, drilling guide of casings or the like. During operation, the seabed template is lowered to the seabed to restrain the rotating and drilling of the outer casings and to clamp the outer casings when the drilling of the outer casings is stopped. Meanwhile, the seabed template may also assist the drilling of the inner casings and the drill pipes.

Figure 2:
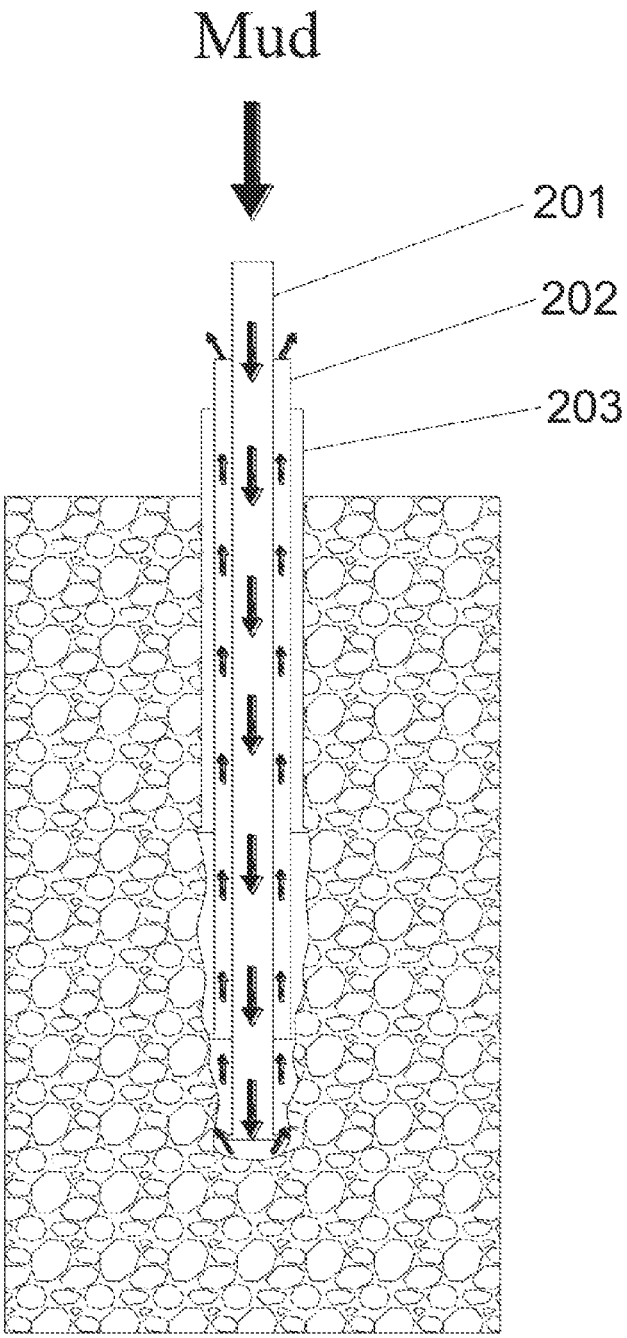
FIG. 2 is a schematic diagram of mud circulation at a drill bit in the method for core drilling according to the present invention.
Figure 3:
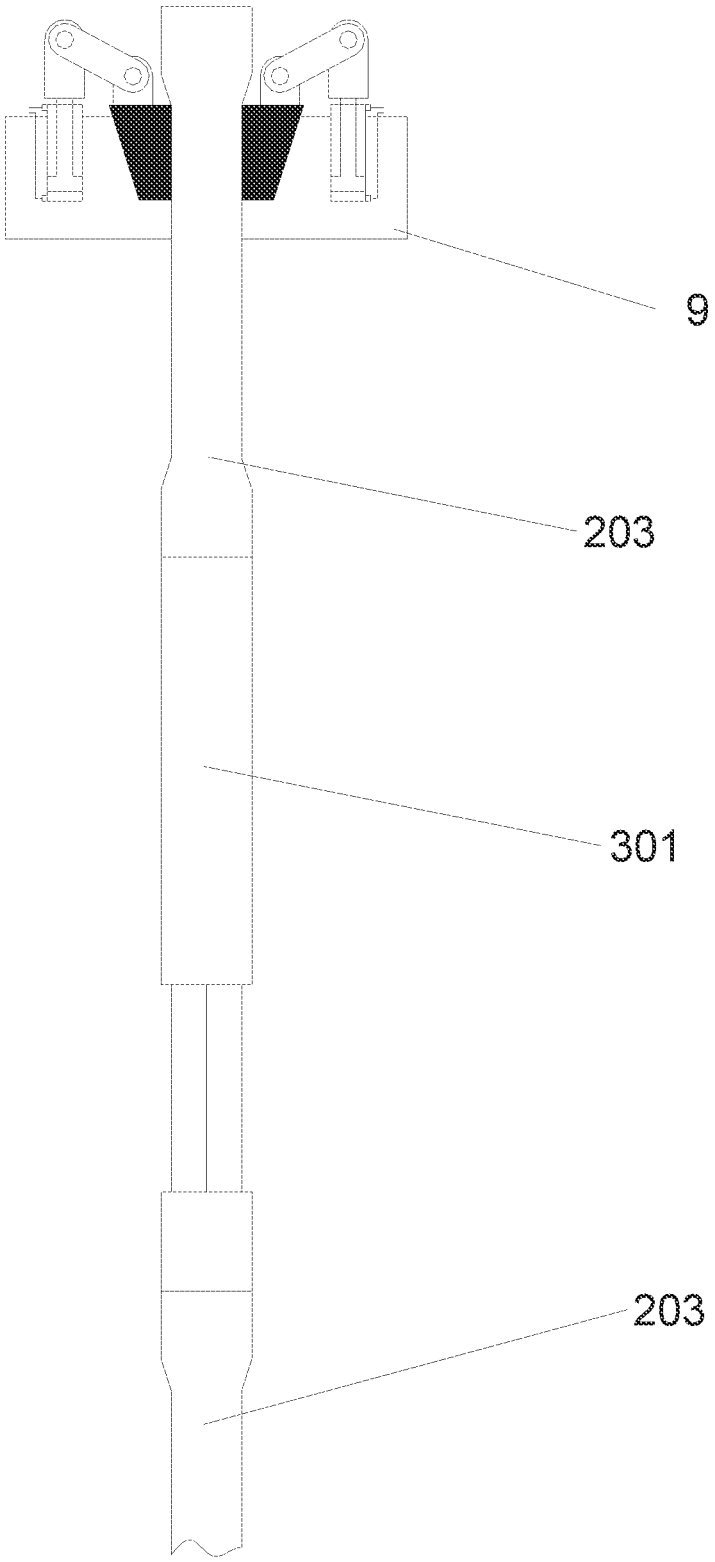
FIG. 3 is a schematic diagram of installation of a surge compensator according to the present invention.

The drilling tool system may be found in FIG. 2 and FIG. 3. The drilling tool system has a structure of three layers of casings, including outer casings 203, inner casings 202, drill pipes 201, and a surge compensator 301. The outer casings are $5\frac{1''}{2}$ casings each having an inner diameter of 121.44 mm. The inner casings 202 are casings each having an outer diameter of 116 mm. The drill pipes each have an outer diameter of 97 mm. A plurality of outer casings 203, a plurality of inner casings 202, and a plurality of drill pipes 201 are provided, and may be spliced for drilling for sampling at different depths. The surge compensator 301 is commercially available and is retractable for connecting the outer casings 203, in particular, the uppermost layer and second layer of outer casings. During drilling for sampling, the pneumatic slip 9 clamps the outer casings 203, and the surge compensator 301 can prevent the outer casing 203 below from colliding with wellhead equipment.

The outer-casing drilling system mainly includes a traveling block 1, a top driver 2, and a hydraulic elevator 3. The top driver 2 is installed on the traveling block 1 and is hydraulically driven to provide the outer casings 203 with a rotating and drilling power. The traveling block 1 is installed on a tower of the drilling vessel 7 and located directly above a moon pool 10, and is vertically movable to provide a longitudinal feed for drilling of the outer casings 203. The hydraulic elevator 3 is installed on a flying ring of the top driver 2 to pick the outer casings 203 and assist buckling of the outer casings 203 to achieve butt joint of the outer casings 203.

The inner-casing and drill-pipe drilling system mainly includes a vertical-spindle type drill 6 and a winch 5. The vertical-spindle type drill 6 is configured to provide the inner casings 202 and the drill pipes 201 with a drilling power. The vertical-spindle type drill is commercially available and is movably installed next to the moon pool 10. Under the push of an oil cylinder, the vertical-spindle type drill may move away from the moon pool 10 during drilling of the outer casings, and move close to the moon pool 10 during drilling of the inner casings and the drill pipes. The winch 5 is an electric crane winch is installed on a deck and provided with a matched pulley 4, drawing head 21 and steel wire rope 22. The steel wire rope 22 is wound around the pulley 4 to connect the winch 5 and the drawing head 21 to hoist the inner casings 202 and the drill pipes 201 for butt-joint installation. At the same time, a drill guide rail 19 of the vertical-spindle type drill 6 is provided with a matched counterweight 20. The counterweight coordinates with the winch 5 to adjust the drilling pressures of the inner casings 202 and the drill pipes 201.

The mud circulation system mainly includes a mud recovery pool 15, a mud filter 16, a mud pool 17, and a mud pump 18, which are installed on the deck. The inner casings 202 are connected to the mud recovery pool 15 by means of a mud recovery joint 14 and a pipeline; the mud recovery pool 15 is connected to the mud filter 16 by means of a pipeline; the mud filter 16 is connected to the mud pool 17 by means of a pipeline; the mud pool 17 is connected to the mud pump 18 by means of a pipeline; the mud pump is connected to an inner bore of the drill pipe 201 by means of a pipeline and a rotary joint, whereby a mud circulation loop is formed. As shown in FIG. 2, mud is pumped from the mud pool 17 by the mud pump 18, enters the drill pipes 201 by means of the rotary joint, and returns from the inner casings 202 via a drill bit; and the returned mud is collected by the mud recovery joint 14 into the mud recovery pool 15 and filtered by the mud filter 16, and then enters the mud pool 17 to achieve mud circulation. Preferably, xanthan gum mud may be used as the mud for taking away rock debris and lubricating the drill pipes to prevent wellbore collapse.

(II) Core drilling is performed by using the device for offshore dual-drive core drilling with three layers of casings under surge compensation. The core drilling specifically includes the following steps.

(1) The drilling vessel 7 is sailed to a designated station; and dynamic positioning is enabled to stabilize a wellhead at a designated sampling position.

(2) An initial position of the vertical-spindle type drill 6 resides next to the right side of the moon pool 10; the seabed template 12 resides in the moon pool 10; the traveling block 1, the top driver 2 and the hydraulic elevator 3 reside on an uppermost end; and the counterweight 20 is limited to an uppermost end of the drill guide rail 19.

(3) The pneumatic slip 9 is opened; the $5\frac{1''}{2}$ outer casing 203 with a drill bit is clamped by the hydraulic elevator 3 and delivered into the pneumatic slip 9 which clamps the outer casing; another $$5\frac{1''}{2}$$

outer casing is continuously clamped with the hydraulic elevator 3 and is aligned to the 5½" outer casing 203 clamped by the pneumatic slip 9; the two outer casings are tightened and buckled; the step is repeated to connect a plurality of $$5\frac{1''}{2}$$

outer casings 203, such that the $$5\frac{1''}{2}$$

outer casings 203 pass through the pneumatic slip 8, the moon pool 10 and the seabed template 12, till the drill bit is close to a seabed; the surge compensator 301 is connected; and then a further another $$5\frac{1''}{2}$$

outer casing 203 is continuously connected, till the drill bit reaches the seabed.

(4) The seabed template 12 is lowered to the seabed.

(5) The top driver 2 is connected to the $$5\frac{1''}{2}$$

outer casings 203; the top driver 2 is started to drill; the $$5\frac{1''}{2}$$

outer casings 203 are lifted after drilling to a certain depth, such that the surge compensator 301 is in a middle position; then the pneumatic slip 9 is closed to clamp the $$5\frac{1''}{2}$$

outer casings 203; the $$5\frac{1''}{2}$$

outer casings 203 are disconnected from the top driver 2; and the top driver 2 is elevated to leave the $$5\frac{1''}{2}$$

outer casings 203 as a first layer of wall protection casings.

(6) The drawing head 21 is connected to the inner casing 202 of 116 mm with a drill bit; the winch 5 is started to draw the steel wire rope 22 to wind around the pulley 4 to drive the drawing head 21 and the inner casing 202 of 116 mm, and to deliver the inner casing into the corresponding $$5\frac{1''}{2}$$

outer casing 203; the inner casing 202 of 116 mm is clamped to a mouth of the $$5\frac{1''}{2}$$

outer casing 203 by callipers; another inner casing 202 of 116 mm is continuously drawn to an interface of the previous inner casing 202 of 116 mm; the two inner casings are bucked and connected; and this step is repeated to connect a plurality of inner casings 202 of 116 mm, till the drill bit reaches the seabed.

(7) The vertical-spindle type drill 6 is pushed by means of an oil cylinder to move leftwards to a wellhead position to connect the inner casings 202 of 116 mm; the counterweight 20 is connected to the drawing head 21; the limit of the counterweight 20 is released; drilling is started to allow the inner casings 202 of 116 mm to begin to rotate; a drilling pressure is adjusted by means of the winch 5 and the counterweight 20; after drilling to a certain footage, drilling is stopped; the inner casings 202 of 116 mm are disconnected from the vertical-spindle type drill 6 to leave the inner casings 202 of 116 mm as a second layer of casings the counterweight 20 is returned to the uppermost end of the drill guide rail 19; the counterweight 20 is disconnected from the drawing head 21; and the vertical-spindle type drill 6 is returned to the initial position.

(8) The drawing head 21 is connected to the drill pipe 201 of 97 mm with the drill bit; the winch 5 is started to draw the steel wire rope 22 to wind around the pulley 4 to drive the drawing head 21 and the drill pipe 201 of 97 mm, and to deliver the drill pipe into the inner casing 202 of 116 mm; the drill pipe 201 of 97 mm is clamped to a mouth of the inner casing 202 of 116 mm by callipers; another drill pipe 201 of 97 mm is continuously drawn to an interface of a previous drill pipe 202 of 97 mm; the two drill pipes are bucked and connected; and this step is repeated to connect a plurality of drill pipes 202 of 97 mm, till the drill bit reaches the seabed.

(9) The vertical-spindle type drill 6 is pushed by the oil cylinder to move leftwards to the wellhead position to connect the drill pipe 201 of 97 mm; the counterweight 20 is connected to the drawing head 21; the limit of the counterweight 20 is released; drilling is started to allow the drill pipe 201 of 97 mm to begin to rotate; the drilling pressure is adjusted by the winch 5 and the counterweight 20; after drilling to a certain footage, a first round is ended; the drill bit is lifted for core drilling; a rock core sample is taken out from the core-drilling drill bit of the drill pipe 201 of 97 mm; and the sample is cut, cataloged and sealed.

(10) A new round is started by reconnecting the drill pipes 201 of 97 mm, till the seabed is reached; the vertical-spindle type drill 6 is connected; the mud pump 18 is turned on to pump mud from the mud pool 17 into the drill pipes 201 of 97 mm; the mud is transported to the drill bit of the drill pipe 201 of 97 mm to take away internal rock debris from a borehole and to return from the inner casings 202 of 116 mm; the mud carrying the rock debris is returned to the mud recovery pool 15 via the mud recovery joint 14, and then filtered via the mud filter 16 to return to the mud pool 17 to achieve mud circulation; the vertical-spindle type drill 6 is started to sweep the borehole till a sampling horizon is reached; the mud pump is turned off; drilling is started for sampling; after drilling to a certain footage, the current round is ended; the drill bit is lifted for core drilling; a rock core sample is taken out from the core-drilling drill bit of the drill pipe 201 of 97 mm; and the sample is cut, cataloged and sealed.

(11) Step (10) is repeated to achieve continuous sampling.

(12) When the drill pipes 201 of 97 mm exceed the inner casings 202 of 116 mm by an excessively long distance and with perception of a difficulty in mud returning and a risk of borehole collapse, drilling is conducted to advance the inner casings 202 of 116 mm to a further depth, and then step (10) is repeated for sampling.

(13) When the inner casings 202 of 116 at the second layer exceed the $$5\frac{1''}{2}$$

outer casings 203 by an excessively long distance and a difficulty occurs during continuous further drilling, drilling is conducted to advance the $$5\frac{1''}{2}$$

outer casings 203 to a further depth, and then to further advance the inner casings 202 of 116 mm.

In summary, according to the method for offshore dual-drive core drilling with three layers of casings under surge compensation of the present invention, the drilling vessel is located at set latitude and longitude coordinates by the dynamic positioning system. The drill pipes are stabilized by the seabed template. Torques and drilling pressures can be transmitted during drilling of the casings by means of surge compensation of the casings at a wellhead. During drilling for sampling, the surge compensation can compensate to a certain extent for a change in water depth caused by rising or falling tides or surge, thereby preventing the casings from colliding with equipment and ensuring the safety of wellhead operation. The drilling of three layers of casings is achieved by means of dual driver heads to effectively protect a well wall, such that high core-drilling rate and good core-drilling quality are achieved during drilling for sampling. Compared with ordinary drilling methods, the present invention has the advantages of high drilling efficiency, high core-drilling rate, simple equipment, high reliability, low cost or the like, and is suitable for shallow drilling of general sedimentary rock strata, as well as for reef limestone strata, sand soil strata or other strata where it is difficult to perform core drilling.

The above embodiments are merely for illustrating the technical concept and features of the present invention, and are intended to enable those of ordinary skill in the art to understand and thereby implement the content of the present invention, but the protection scope of the present invention cannot be limited thereto. Any equivalent changes or modifications made according to the substantial contents of the present invention should be construed as falling within the protection scope of the present invention.

What is claimed is:

1. A method for offshore dual-drive core drilling with three layers of casings under surge compensation, comprising steps of:

(1) providing a device for offshore dual-drive core drilling with three layers of casings under surge compensation, the device comprising:

a drilling vessel with a dynamic positioning system, wherein the drilling vessel has a deck provided with a moon pool and a tower, the moon pool is provided with a moon pool cover on a top, the moon pool cover is provided with a pneumatic slip in a center, and an elevatable seabed template is suspended in the moon pool;

a drilling tool system, comprising outer casings, inner casings, drill pipes, and a surge compensator, wherein the surge compensator is configured to connect the outer casings to prevent the outer casings from colliding with wellhead equipment;

an outer-casing drilling system, comprising a tower-mounted traveling block, a top driver mounted on the tower-mounted traveling block, and a hydraulic elevator mounted on the top driver, wherein the top driver is configured to provide the outer casings with a rotation power, the tower-mounted traveling block is vertically movable and configured to provide a longitudinal feed to achieve drilling of the outer casings, and the hydraulic elevator is configured to pick the outer casings and assist buckling of the outer casings;

an inner-casing and drill-pipe drilling system, comprising a vertical-spindle type drill and a winch, wherein the vertical-spindle type drill is movably mounted next to the moon pool and is configured to provide the inner casings and the drill pipes with a drilling power, the winch is mounted on the deck, configured to hoist the inner casings and the drill pipes and provided with a matched drawing head, the vertical-spindle type drill has a drill guide rail provided with a matched counterweight, and a drilling pressure is adjusted for the inner casings and the drill pipes by coordination between the counterweight and the winch; and a mud circulation system, comprising a deck-mounted mud recovery tank, a mud filter, a mud pool, and a mud pump, wherein the inner casings are connected to the mud recovery pool by a first pipeline, the mud recovery pool is connected to the mud filter by a second pipeline, the mud filter is connected to the mud pool by a third pipeline, the mud pool is connected to the mud pump by a fourth pipeline, and the mud pump is connected to the drill pipes by a fifth pipeline, thereby forming a mud circulation loop; and (II) performing core drilling by using the device for offshore dual-drive core drilling with three layers of casings under surge compensation, comprising:

(1) sailing the drilling vessel to a designated station, and enabling dynamic positioning to stabilize a wellhead at a designated sampling position;

(2) allowing an initial position of the vertical-spindle type drill to reside next to the moon pool, the elevatable seabed template to reside in the moon pool, and the tower-mounted traveling block, the top driver and the hydraulic elevator to reside on an uppermost end, and limiting the counterweight to an uppermost end of the drill guide rail;

(3) opening the pneumatic slip, clamping the outer casing with a drill bit by the hydraulic elevator, delivering the outer casing into the pneumatic slip which clamps the outer casing, continuing to clamp another outer casing with the hydraulic elevator, aligning the another outer casing to the outer casing clamped by the pneumatic slip, tightening and buckling the outer casings, repeatedly connecting a plurality of outer casings such that the outer casings pass through the pneumatic slip, the moon pool and the elevatable seabed template till the drill bit is close to a seabed, connecting the outer casings to the surge compensator, and then continuing to connect the outer casing, till the drill bit reaches the seabed;

(4) lowering the elevatable seabed template to the seabed;

(5) connecting the top driver to the outer casings, starting the top driver to drill, lifting the outer casings after drilling to a certain depth such that the surge compensator is in a middle position, then closing the pneumatic slip to clamp the outer casings, disconnecting the outer casings from the top driver, and elevating the top driver to leave the outer casings as a first layer of wall protection casings;

(6) connecting the drawing head to the inner casing with a drill bit, starting the winch, delivering the inner casing into the corresponding outer casing, clamping the inner casing to a mouth of the outer casing by callipers, continuing to draw another inner casing to an interface of the previous inner casing, buckling and connecting the inner casings, and repeatedly connecting a plurality of inner casings, till the drill bit reaches the seabed;

(7) moving the vertical-spindle type drill to a wellhead position to connect the inner casings, connecting the counterweight to the drawing head, releasing the limit of the counterweight, starting drilling to allow the inner casings to begin to rotate, adjusting a drilling pressure by the winch and the counterweight, stop drilling after drilling to a certain footage, disconnecting the inner casings from the vertical-spindle type drill to leave the inner casings as a second layer of casings, returning the counterweight to the uppermost end of the drill guide rail, disconnecting the counterweight from the drawing head, and returning the vertical-spindle type drill to the initial position;

(8) connecting the drawing head to the drill pipe with the drill bit, starting the winch to deliver the drill pipe into the inner casings, clamping the drill pipe to the mouth of the inner casing by the calipers, continuing to draw another drill pipe to an interface of the previous drill pipe, buckling and connecting the inner casings, and repeatedly connecting a plurality of drill pipes, till the drill bit reaches the seabed;

(9) moving the vertical-spindle type drill to the wellhead position again to connect the drill pipes, connecting the counterweight to the drawing head, releasing the limit of the counterweight, starting drilling to allow the drill pipe to begin to rotate, adjusting the drilling pressure by the winch and the counterweight, ending a first round after drilling to a certain footage, lifting the drill bit for core drilling, taking out a rock core sample from the core-drilling dill bit of the drill pipe, and cutting, cataloging and sealing the rock core sample;

(10) starting a new round by reconnecting the drill pipes till the seabed is reached, connecting the vertical-spindle type drill, starting the mud pump to pump mud from the mud pool into the drill pipes, transporting the mud to the drill bit of the drill pipe to take away internal rock debris from a borehole and to return from the inner casings, returning the mud carrying the rock debris to the mud recovery pool, filtering the mud by the mud filter, returning the mud to the mud pool to achieve mud circulation, starting the vertical-spindle type drill to sweep the borehole till a sampling horizon is reached, turning off the mud pump, starting drilling for sampling, ending a current round after drilling to a certain footage, lifting the drill bit for coring, taking out a rock core sample from the coring dill bit of the drill pipe, and cutting, cataloging and sealing the rock core sample; and

(11) repeating step (10) to achieve continuous sampling.

2. The method for offshore dual-drive core drilling with three layers of casings under surge compensation according to claim 1, further comprising:

(12) when the drill pipes exceed the inner casings by an excessively long distance and with perception of a difficulty in mud returning and a risk of borehole collapse, drilling to advance the inner casings to a further depth, and then repeating step (10) for sampling.

3. The method for offshore dual-drive core drilling with three layers of casings under surge compensation according to claim 2, further comprising:

(13) when the inner casings exceed the outer casings by an excessively long distance and a difficulty occurs during continuous further drilling, drilling to advance the outer casings to a further depth, and then drilling to advance the inner casings.

4. The method for offshore dual-drive core drilling with three layers of casings under surge compensation according to claim 1, wherein the outer casings are $$5\frac{1''}{2}$$

casings.

5. The method for offshore dual-drive core drilling with three layers of casings under surge compensation according to claim 1, wherein the inner casings each have an outer diameter of 116 mm.

6. The method for offshore dual-drive core drilling with three layers of casings under surge compensation according to claim 1, wherein the drill pipes each have an outer diameter of 97 mm.

7. The method for offshore dual-drive core drilling with three layers of casings under surge compensation according to claim 1, wherein the mud is xanthan gum mud for taking away the rock debris and lubricating the drill pipes to prevent borehole collapse.

* * * * *